United States Patent [19]

Limbach

[11] Patent Number: 4,747,165

[45] Date of Patent: May 31, 1988

[54] BELT AND BUCKLE

[76] Inventor: Karl A. Limbach, 49 Bellevue, Belvedere, Calif. 94920

[21] Appl. No.: 903,037

[22] Filed: Sep. 2, 1986

[51] Int. Cl.[4] ..... A41F 9/00

[52] U.S. Cl. ..... 2/322; 2/311; 2/321; 24/176; 24/186

[58] Field of Search ..... 2/311, 312, 317, 318, 2/321, 322; 24/163 K, 176, 182, 186, 265 BC; 224/163

[56] References Cited

U.S. PATENT DOCUMENTS

| | | | |
|---|---|---|---|
| 1,213,650 | 1/1917 | Hutchinson | 2/322 X |
| 1,388,401 | 8/1921 | Bolig | 24/176 |
| 2,898,602 | 8/1959 | Moss | 2/322 X |
| 3,017,641 | 1/1962 | Stollman | 2/322 |
| 3,823,421 | 7/1974 | Collins | 2/321 |
| 3,823,422 | 7/1974 | Forgett, Jr. | 2/321 |
| 3,913,147 | 10/1975 | Ostrander | 2/311 X |
| 4,078,272 | 3/1978 | Mahon, III | 24/186 |
| 4,477,949 | 10/1984 | Calabro | 24/186 X |

*Primary Examiner*—Werner H. Schroeder
*Assistant Examiner*—J. L. Olds
*Attorney, Agent, or Firm*—Limbach, Limbach & Sutton

[57] ABSTRACT

A belt with a removable buckle containing a cork puller where the belt can be reversed to change color when the buckle is removed and may be trimmed for different sizes.

3 Claims, 1 Drawing Sheet

BELT AND BUCKLE

BACKGROUND OF INVENTION

A belt has been sold for a number of years under the trademark "WINE BELT" in which the belt buckle is made from a two-spring cork puller of the type sold under the trademark "AH-SO." The cork puller is mounted in a leather pocket on the back of the belt, and an enlarged pin projects from the cork puller for interconnecting the ends of the belt. The belt is "buckled" by inserting the free end of the belt through the handle loop of the cork puller and inserting the pin through one of several holes punched in the free end of the belt. A leather belt loop is provided encircling the belt and slidable along the belt's length.

This belt had several serious disadvantages. In the first place, it was necessary to make the belt in only wide sizes, because of the need to stitch the pocket onto the back of the belt along the sides of the cork puller. Additionally, the belt loops were apt to be lost because they could slip off of the free end of the belt.

An improved form of belt which solved these problems was made and destributed to a limited extent. In the improved belt, the sleeve part of the cork puller was attached the the belt by rivets, and the belt loop was permanently attached to the belt by mounting it between the two rivets captured between the sleeve and the belt.

While the improved belt solved some of the problems of the origional design, both designs suffered from the fact that they required special fabrication at both ends of the belt with dedicated inventory for each size and color of belt.

SUMMARY OF INVENTION

In accordance with this invention, I have provided a new design of belt using a two-spring cork puller as the buckle in which manufacture of the belt is greatly simplified by constructing the buckle in a manner that it can be slid onto and off of the belt and attached to the belt solely by its own parts connecting to a center hole in one end of the belt.

Additionally, the belt may be reversed easily to provide two different colored belts.

Inventory control is greatly simplified because longer belts can be cut down for shorter sizes simply by sliding the buckle off on the belt, cutting segments off of the buckle end of the belt and punching a single new center hole, and sliding the buckle back onto the belt. Trimming the belt at the buckle end instead of the free end avoids the need to color the cut end, because the buckle end is covered by the buckle.

The belt of this invention may be made with a variety of two-spring cork pullers, but I prefer to use the cork pullers sold under the trademark "AH-SO" in which the two springs are the opposite ends of the same spring which is bent into a "U" shape. Additionally, it will be apparent that the buckles of this invention may be made with other tools in the buckle instead of cork pullers by mounting other tools like screw drivers, wrenches, and the like, in place of the "U" shaped spring.

The elongated pin of the buckle is provided in the same manner that it was provided in the old belts mentioned above where the short pin normally holding the spring in the "AH-SO" was removed and replaced by a longer pin protruding from the cork puller by a distance approximately equal to twice the thickness of the belting material. Of course the belting material may be woven roping in which no holes need be punched, but leather belting is preferred with one center hole in the buckle end and five center holes in the free end.

In the preferred design of the buckle of my invention, a sheath, like the standard "AH-SO" sheath, is used to enclose the springs of the cork puller and protect the wearer from injury by the springs. One belt loop is integrally formed with the sheath near the mouth of the sheath in which the cork puller is mounted. This belt loop serves to hold the sheath onto the belt so that the buckle doesn't fall off of the belt when it is unbuckled. Preferably, this belt loop is set back slightly from the end of the sheath in order that the belt can be bent upwardly off of the pin without sliding the cork puller out of the sheath when it is desired to remove the cork puller from the belt for cork pulling. A second belt loop with an opening double the thickness of the belt is integrally formed near the opposite end of the sheath in order to align the sheath with the length of the belt and to retain the free end of the belt when the belt is buckled.

In one special design of my belt, several holes for several different size belts are provided in the buckle end of the belt with score marks for cutting the belt to the different sizes. With this design, a single belt can be prepunched and scored at the buckle end for four sizes, such as 32, 34, 36, and 38 inch lengths. The exter holes are not visible when the belt is worn on a size 38 waist, because the exter three holes are concealed by the free end of the buckled belt. The 38 inch belt can be converted to a 32 inch belt by sliding off the buckle, cutting off the part of the belting containing the 38, 36, and 34 size holes, and sliding the buckle back on. The savings from inventory control thus obtained far exceeds the cost of the belting wasted when the size 38 belt is cut down to size 32.

DETAILED DESCRIPTION

In the attached drawing

Figure 1:
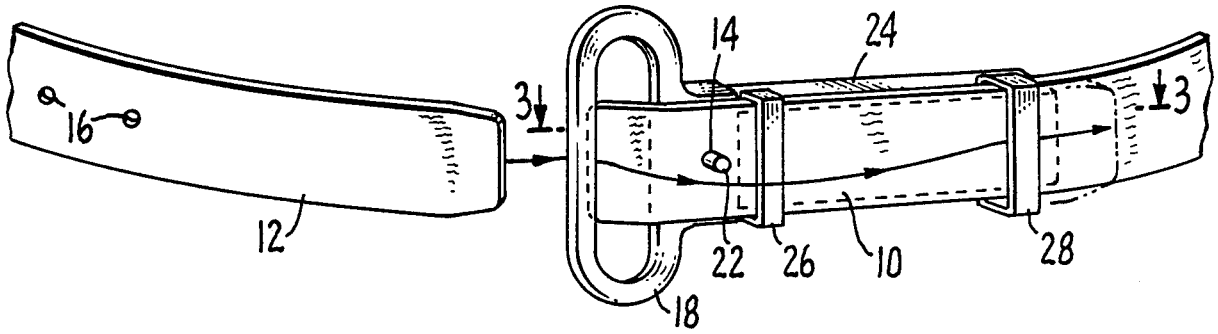
Figure 2:
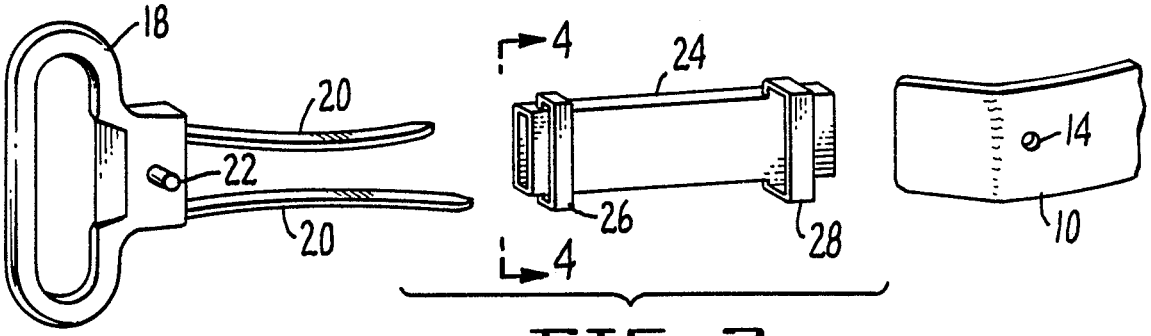
Figure 3:
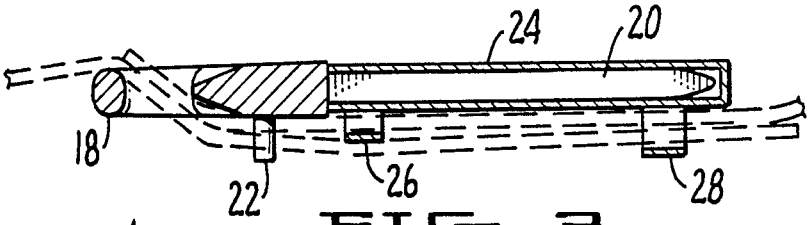
Figure 4:
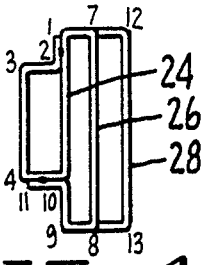
Figure 6:
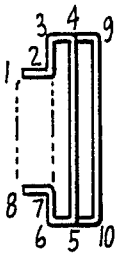
Figure 8:
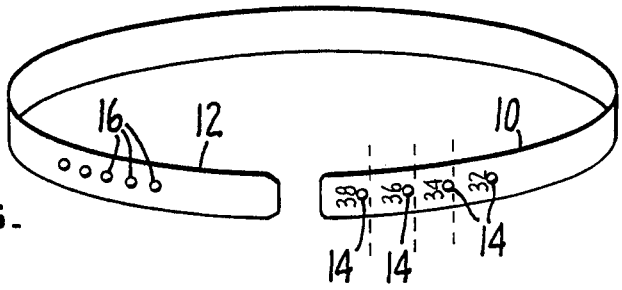
Figure 5:
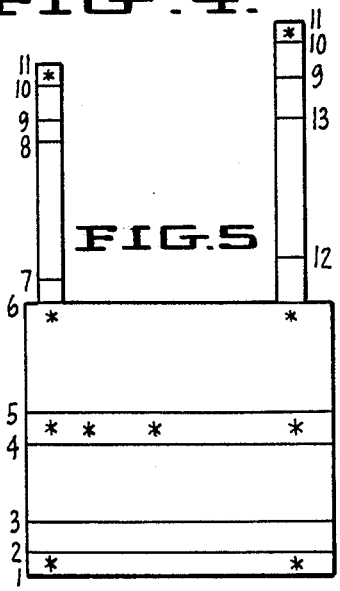
Figure 7:
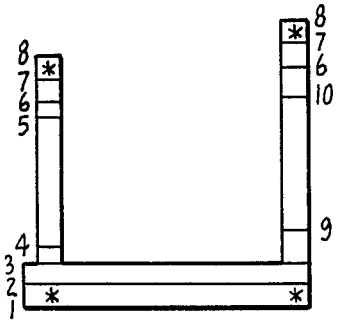

FIG. 1 is a fragmentary view of a belt constructed in accordance with the principles of the invention illustrating the manner in which the belt is buckled, FIG. 2 is an exploded view of the buckle end of the belt and buckle of FIG. 1, FIG. 3 is a sectional view showing the manner in which the belt is buckled, FIGS. 4 and 5 are folded and unfolded views of the sleeve portion of an alternative form of buckle fabricated by folding a metal blank, FIGS. 6 and 7 are views similar to FIGS. 4 and 5 showing an additional alternative, and FIG. 8 is a view of a special belt adapted to be used with the buckle of FIG. 1 for four alternative belt sizes.

Referring now in detail to the drawing, the preferred form of my invention illustrated therein consists of a belt having a buckle end 10 and a free end 12 with a single hole 14 in the buckle end and having a series of five holes 16 in the free end.

The buckle of the belt is made from a two spring cork puller of the type sold under the trademark AH-SO, having a gripping handle 18, a pair of spring fingers 20, and a pin 22 generally perpendicular to the length of the belt, which penetrates through the handle portion 18 locking the spring fingers 20 in place by means of a central body portion, not shown. The spring fingers 20 are received in a sleeve-shaped body member 24 generally parallel to the length of the belt, and a pair of belt loops 26 and 28 are integrally formed with the sleeve 24. As illustrated in FIG. 3, the belt loop 26 has a depth slightly larger than one thickness of the belt 12, and the belt loop 28 has a depth slightly larger than two thicknesses of the belt 12.

The belt buckle is mounted on the buckle end of the belt by sliding the spring fingers 20 into the sleeve 24, inserting the buckle end of the belt through the belt loops 28 and 26, and then inserting the pin 22 through the hole 14. The belt is then buckled by inserting the free end of the belt 12 along the path indicated by the arrow in FIG. 1 first through the gripping handle 18, then over the belt loop 26 and under the belt loop 28 and inserting the pin 22 through a selected one of the holes 16.

As illustrated in FIG. 8, the buckle end of the belt 10 may be provided with four pre-punched holes 14 for four different sizes of belts, so that the belt may be cut off at the positions indicated by the three dotted lines for the three shorter belt sizes, and preferably the belt is stamped with size indicia corresponding to the four different holes as illustrated.

Preferably the sleeve of the buckle constructed as illustrated in FIG. 2 is manufactured as a single cast piece of metal, though it can be fabricated in a number of alternative ways, and the belt loops 26 and 28 may be fabricated in different widths, depending particularly upon the desirability of providing advertising indicia on one or both of the belt loops. The cork puller portion of the buckle is conveniently fabricated by replacing the standard pin of an AH-SO with a longer pin as described above.

As illustrated in FIGS. 4–7, the sleeve and belt loops can also be fabricated by folding a stamped metallic blank, the sequence of folds being illustrated by the corresponding numbers in FIGS. 4 and 5 with the folds spot welded together as indicated at the circular areas. In a similar manner, a blank can be folded as illustrated at FIGS. 6 and 7 to be soldered onto the outside of the sleeve which forms a part of the conventional AH-SO wine opener.

While certain features and advantages of the invention have been described in detail herein, it is obvious that many modifications thereof may be made without departing from the spirit and scope of the invention.

I claim:

1. A belt having a buckle end with at lest one hole and free end with a series of holes by which the belt can be buckled at a series of different lengths, a body member slidably received on the buckle end of the belt and adapted to be slid off and on the belt, a tool slidably received in the body member, and a pin rigidly attached to the tool and extending through the hole in the buckle end of the belt and adapted to engage the holes of the series of holes in the free end of the belt with the pin removable from the hole in the buckle end of the belt to permit removal of the tool from the belt and from the body member in which the tool is a two spring cork puller with the springs thereof slidably received in the body member generally parallel to the length of the belt, and the pin is rigidly mounted in the cork puller generally perpendicular to the length of the belt.

2. The belt of claim 1 characterized further by the inclusion of a belt loop integrally formed with said body member and positioned to hold the free end of the belt when the belt is buckled.

3. A belt buckle comprising an elongated body member, the body member having a portion thereof adjacent to one end of the body member shaped to encircle a belt and support the body member on a belt for slidable movement onto and off of the belt, a two-spring cork puller slidably received in the one end of the body member and having a handle member spaced from the body member and adapted to encircle a belt, a pin on the cork-puller between the body member and the handle loop and extending generally perpendicular to the length of the body for interconnecting holes in the opposite ends of a belt on which the body is mounted, and a belt loop attached to the body member on the opposite end of the body member from the cork puller.

* * * * *